US011427453B2

(12) United States Patent
Dal Lago et al.

(10) Patent No.: US 11,427,453 B2
(45) Date of Patent: Aug. 30, 2022

(54) DEVICE AND METHOD FOR FILLING CONTAINERS WITH A LIQUID, IN PARTICULAR FOR BOTTLING

(71) Applicant: DR TECH S.R.L., Minerbe (IT)

(72) Inventors: Livio Dal Lago, Albaredo d'Adige (IT); Alberto Ruggin, Bonavigo (IT)

(73) Assignee: DR TECH S.R.L., Minerbe (IT)

( * ) Notice: Subject to any disclaimer, the term of this patent is extended or adjusted under 35 U.S.C. 154(b) by 0 days.

(21) Appl. No.: 16/309,302

(22) PCT Filed: Jun. 12, 2017

(86) PCT No.: PCT/IB2017/053450
§ 371 (c)(1),
(2) Date: Dec. 12, 2018

(87) PCT Pub. No.: WO2017/216697
PCT Pub. Date: Dec. 21, 2017

(65) Prior Publication Data

US 2019/0241419 A1 Aug. 8, 2019

(30) Foreign Application Priority Data

Jun. 13, 2016 (IT) ..... 102016000060193

(51) Int. Cl.
*B67C 3/10* (2006.01)
*B67C 3/22* (2006.01)
*B67C 3/26* (2006.01)

(52) U.S. Cl.
CPC ..... *B67C 3/10* (2013.01); *B67C 3/222* (2013.01); *B67C 3/2614* (2013.01); *B67C 2003/2671* (2013.01)

(58) Field of Classification Search
CPC ..... B67C 3/10; B67C 3/222; B67C 3/2614; B67C 2003/2671
(Continued)

(56) References Cited

U.S. PATENT DOCUMENTS 531,717 A * 1/1895 Clauss, Jr. ..... B67C 3/2637 141/292
773,573 A * 11/1904 Wiliam ..... B01F 3/04475 141/62
(Continued)

FOREIGN PATENT DOCUMENTS

DE 3132747 A1 * 3/1983 ..... B67C 3/26
EP 0166803 A1 * 1/1986 ..... B67C 3/262
(Continued)

OTHER PUBLICATIONS

International Search Report (PCT/ISA/210) issued in PCT/IB2017/053450, dated Oct. 18, 2017.
(Continued)

*Primary Examiner* — Kenneth Rinehart
*Assistant Examiner* — James R Hakomaki
(74) *Attorney, Agent, or Firm* — Birch, Stewart, Kolasch & Birch, LLP

(57) ABSTRACT

A device for filling containers with a liquid includes a filling unit; an elevating mechanism; and optionally a conveyor suitable to support and have the containers advance in succession to the filling unit. The filling unit includes connections connected to a source of the liquid, a source of an inert gas and a suction device; a pipe comprising a first tube and a second tube, and a retainer to hold the containers in the filling unit. The elevating mechanism varies the depth with which the pipe and/or at least one of the tubes is inserted in the container. A method for filling containers with a liquid is also provided, wherein the liquid and an inert gas are injected simultaneously through two separate tubes. The tubes are each connectable/connected to one of the connections connectable/connected to a source of liquid, a source of an inert gas and to a suction device.

18 Claims, 10 Drawing Sheets

(58) Field of Classification Search
USPC ..... 141/275, 67
See application file for complete search history.

(56) References Cited

U.S. PATENT DOCUMENTS

| | | | | | |
|---|---|---|---|---|---|
| 1,325,991 | A * | 12/1919 | King | B67D 7/54 | 141/59 |
| 1,437,916 | A * | 12/1922 | Shelor | B67C 3/16 | 141/45 |
| 2,360,198 | A * | 10/1944 | Carter | B65B 43/58 | 141/59 |
| 2,685,396 | A * | 8/1954 | Day | B67C 3/2637 | 141/55 |
| 2,839,094 | A * | 6/1958 | Reno | B67C 3/2637 | 141/84 |
| 3,037,536 | A * | 6/1962 | Fechheimer | B67C 3/16 | 141/7 |
| 3,093,165 | A * | 6/1963 | Risser | B67C 3/04 | 141/140 |
| 3,094,213 | A * | 6/1963 | Wyman | G01F 23/292 | 209/524 |
| 3,212,537 | A * | 10/1965 | Hinxlage | B67C 3/10 | 141/6 |
| 3,454,759 | A * | 7/1969 | Calhoun | G01F 23/2921 | 250/338.1 |
| 3,516,455 | A * | 6/1970 | Carter | B67C 3/06 | 141/90 |
| 3,563,379 | A * | 2/1971 | Stapf | B65G 47/848 | 209/524 |
| 3,580,299 | A * | 5/1971 | Alkalay | B67C 3/16 | 141/59 |
| 3,645,303 | A * | 2/1972 | Carter | B67C 3/16 | 141/7 |
| 3,699,740 | A * | 10/1972 | Knabe | B67C 3/10 | 53/432 |
| 4,436,124 | A * | 3/1984 | Borstelmann | B67C 3/10 | 141/37 |
| 4,679,603 | A * | 7/1987 | Rademacher | B67C 3/2614 | 141/165 |
| 4,691,842 | A * | 9/1987 | Foures | B67D 1/04 | 222/1 |
| 4,749,010 | A * | 6/1988 | Petell | B67C 3/2608 | 141/115 |
| 5,031,673 | A * | 7/1991 | Clusserath | B67C 3/004 | 141/6 |
| 5,538,054 | A * | 7/1996 | L uhmann | B67C 3/007 | 141/198 |
| 6,112,780 | A * | 9/2000 | Meheen | B67C 3/10 | 141/54 |
| 6,457,495 | B1 * | 10/2002 | Meheen | B67C 3/10 | 141/40 |
| 6,753,527 | B1 * | 6/2004 | Yamagishi | G01F 23/2921 | 250/223 B |
| 8,578,760 | B2 * | 11/2013 | Calhoun | G01M 3/32 | 73/49.3 |
| 2003/0150517 | A1 * | 8/2003 | Decarne | B67C 3/26 | 141/286 |
| 2013/0220477 | A1 * | 8/2013 | Seeman | B65B 3/30 | 141/1 |
| 2015/0203444 | A1 * | 7/2015 | Trend | C07C 259/06 | 514/575 |
| 2016/0023877 | A1 * | 1/2016 | Gai | B67C 3/2617 | 141/312 |
| 2016/0025267 | A1 * | 1/2016 | Clusserath | B67C 3/10 | 141/4 |
| 2020/0002147 | A1 * | 1/2020 | Jones | B67C 3/12 | |

FOREIGN PATENT DOCUMENTS

| | | | | |
|---|---|---|---|---|
| EP | 0 960 852 | A2 | 12/1999 | |
| EP | 1270499 | A1 * | 1/2003 | B67C 3/10 |
| EP | 3026007 | A1 * | 6/2016 | B67C 3/2614 |
| GB | 1066575 | A | 4/1967 | |
| WO | WO-9911559 | A1 * | 3/1999 | B65B 31/044 |
| WO | WO 2016/013941 | A2 | 1/2016 | |
| WO | WO 2016/030786 | A1 | 3/2016 | |

OTHER PUBLICATIONS

Written Opinion (PCT/ISA/237) issued in PCT/IB2017/053450, dated Oct. 18, 2017.

* cited by examiner 9.1

9.2

9.3

9.4

9.5

9.6

DEVICE AND METHOD FOR FILLING CONTAINERS WITH A LIQUID, IN PARTICULAR FOR BOTTLING

TECHNICAL FIELD

This invention relates to a device and method for filling containers with a liquid, in particular for bottling. This device and method were created to allow the filling of containers with liquids sensitive to oxygen, i.e. filling occurs in an inert atmosphere. This invention may be used in various bottling plants, such as line plants, alternate motion plants, be they rotary plants or continuous plants, but also semi-automatic plants. This device and method specifically refer to the bottling of wine into glass bottles.

STATE OF THE ART

In the bottling sector, the wine bottling sector for instance, what has been known for a long time is the issue relating to the need of reducing oxygen absorption by wine as much as possible during the filling steps and the need of taking the utmost care in order to avoid bacterial contamination, which would irreparably affect the quality of the bottled wine.

The known bottling plants currently use a filling method that essentially envisages a preliminary step during which nitrogen is injected inside the bottle to be filled by means of a multi-cable injector nozzle that is partially inserted in the neck of the bottle so as to allow the air-nitrogen mixture that has been created inside the bottle to later come out through the empty space created by the nozzle at the outlet mouth of the bottle.

The mouth of the bottle is then sealed by means of a filling tap that coaxially comprises the aforementioned nitrogen injector nozzle; vacuum is then created inside the bottle; and wine is then poured into the bottle, which flows on the surfaces of the internal walls of the bottle from its neck to its bottom. The correct filling level is achieved by sucking out of the bottle the exceeding quantity of wine. The nozzle is wet with wine, is removed and inserted into the next bottle.

This above traditional method has been proposed by the inventors in the patent application WO 2016/030786 A1, wherein the filling of the bottle occurs by means of a pipe sliding inside the bottle, the liquid comes out of the pipe at the bottom of the bottle and then its level rises up to the neck, thus reducing turbulence, which would instead be created in the liquid if it poured down along the bottle walls to reach the bottom. Such turbulence favours oxygen absorption.

However, these methods are currently unable to almost fully eliminate the oxidative phenomena affecting wine, especially along the internal surfaces of the bottle, because of the residues of oxygen inside the bottle, or to allow the correct management of the bottling plant so as to ensure an adequate protection against bacterial contamination.

In the British document GB 1 066 575 and also in document EP 0 960 852 A2, a method and device are disclosed and aimed at filling containers with a liquid, and envisage the simultaneous injection of a liquid and an inert gas. The devices described in both documents do not envisage a suction system that might be able to create vacuum inside the container. Document WO 2016/013941 A2 finds a solution to the issue concerning the formation of foam during filling with a carbonated liquid by immersing the nozzle into the liquid during the filling procedure.

DISCLOSURE OF THE INVENTION

This invention wants to overcome the above mentioned drawbacks, and precisely wants to propose a device and a method for filling containers with a liquid, in particular for bottling, which improves the known systems in the state of the art as for the reduction of oxygen absorption. Another object of this invention is proposing a device and method for filling containers with a liquid, in particular for bottling, which reduces bacterial contamination.

The above mentioned objects are achieved—in a first aspect of the invention—by means of a device intended for filling containers with a liquid, especially for bottling, according to the first claim, which comprises:

(a) a filling unit comprising
  (a1) connections suitable to be connected to a source of liquid, a source of inert gas and a suction device;
  (a2) a pipe which comprises
  (a2.1) a first tube and
  (a2.2) a second tube,
  wherein the first tube is arranged as central tube essentially coaxially inside said second tube creating, between said first tube and said second tube, a corresponding interstice
  or
  wherein said first and said second tube extend separately from each other, for example in parallel; and
  (a3) retaining means to hold said container in said filling unit;
(b) elevating means to vary the depth with which said pipe, and/or at least one of said tubes, is inserted in said container; and
(c) optionally conveyor means suitable to support and have said containers advance in succession to said filling unit, wherein said tubes are each connectable/connected to one of said connections connectable/connected to a source of liquid, a source of an inert gas and to a suction device.

There may be various types of liquids. Liquids for food use are preferred, such as wine, beer, fruit juices and/or vegetable juices, mineral water, milk, liquid yoghurt, vinegar, oil, spirits, liqueurs, sparkling wine, tea, lemonade etc. Wine is particularly preferred.

There may also be various types of containers and materials. Materials such as glass, impregnated cardboard (Tetra Pak®), plastic are conceivable. The preferred container is a glass bottle.

The inert gas is advantageously nitrogen, but other inert gases might be suitable too, provided that they do not alter the characteristics of the liquid, e.g. noble gases and carbon dioxide (which affects the pH of the liquid though). Heavier gases than air have the advantage of not coming out of the container and pushing the air up. Heavier gases than air, argon for instance, properly covers the surface of the liquid without rising and uncovering the liquid. Said gases may also be used as mixtures, such as mixtures of argon and carbon dioxide, or argon and nitrogen.

The variant in which the first tube is arranged as central tube essentially coaxially inside said second tube creating, between said first tube and said second tube, a corresponding interstice is advantageous as for the room it takes, and the uniformity of the fluid distribution, which simultaneously flow out from both tubes.

Tubes may have different sections, such as, in particular, a circular section. The extension of the tubes may be essentially straight or, for instance, it may be a spiral extension.

Alternative configurations of the two tubes with respect to the coaxial or parallel configuration could be, for instance, spiral tubes, wherein a spiral essentially follows the development of the other one, thus tubes extend one next to the other, or wherein spirals are intertwined. A spiral tube wrapped around a straight tube is also conceivable.

Elevating means allow the pipe, or at least one of the two tubes, to be positioned close to the bottom of the container to allow the liquid and/or an inert gas to rise from the bottom up. As for wine, turbulence is avoided and foam formation is reduced. As far as gas is concerned, containers are washed from the bottom and the entire volume of the container is involved; moreover, a gas cushion may be created above the liquid, especially when the inert gas is heavier than air.

Conveyor means are needed for the automatic operation of the device according to the invention. A manual insertion of the container in the filling unit is also conceivable.

The presence of two tubes in the pipe allows to simultaneously inject inert gas and liquid into the container, thus further reducing the presence of air (oxygen), this is also due to two separate channels for gas and liquid. What can also be done is simultaneously using one tube for vacuum and the other one for gas or liquid, so intensifying air (oxygen) to be pushed out. The fact that said tubes are each connectable/connected to one of said connections connectable/connected to a source of liquid, a source of an inert gas and to a suction device, i.e. the simultaneous presence of three different circuits, ensures that the plant can be managed in an atmosphere that can be controlled with respect to all aspects. Such a separate management and, if needed, the application of gas, liquid and vacuum—individually, simultaneously or in pairs—is not known in the state of the art, to the inventors' knowledge, and often it does not envisage the closing of the bottle during bottling, in such a way vacuum cannot be applied or air and/or micro-organisms cannot be excluded. A tube is preferably connected to the connection connectable/connected to a source of liquid, and the other tube to the connection connectable/connected to said source of an inert gas. In an advantageous variant of the invention, the above-mentioned system also allows the alternating use of gas and vacuum.

Therefore, by using the above described double-tube pipe, the exchanging surfaces and the contact between liquid and air are mechanically limited. Since it is possible to position the pipe close to the bottom of the container by using the elevating means, the filling from the bottom exerts less stress on the liquid, thus ensuring an excellent quality and durability of the liquid over time, especially in the case of wine that is bottled in this way.

In two preferred embodiments of the invention, the elevating means are suitable to move the pipe and/or at least one of the tubes in an axial direction and/or means suitable for elevating and lowering a support on which said container is placed in said filling unit. In a preferred embodiment, the elevating means move the pipe or at least one of the two tubes to move it closer to the bottom of the container or to move it away from the bottom. The support holds the container by raising itself with respect to the pipe or a fixed tube, and can move the opening of the pipe or of the tube closer to or away from the bottom of the container. What is also possible is using both methods at the same time, i.e. the movement of the pipe/tube and the movement of the support. The elevating means allow the container to be filled from any height inside the container.

In another embodiment of the invention, the first and second tubes can be raised or lowered independently of each other, thus allowing, for instance, a bottom up filling of the container with liquid or inert gas and the creation of vacuum from above, if vacuum is created by means of one of the tubes. The resulting different height of the two tubes allows liquid and gas to be injected, or vacuum to be created from different heights.

Preferably, the filling unit can close the container so that it creates negative pressure or vacuum by means of the suction device. Advantageously, the retaining means have elements intended for closing the container. Advantageously, the vacuum is created through a space, a kind of channel, which is independent from the channels formed by the pipe or its tubes, such as an annular channel surrounding (at least) the upper part of the pipe, thus creating a sort of triple tube. Advantageously, the vacuum can be created in the upper part of the container. Vacuum might also be applied on at least one of the tubes, thus helping to clean the latter of gas and vapours. What can also be taken into consideration is a filling unit, wherein vacuum can be created—depending on one's choice—into one of the two tubes or an opening separated by this at least one tube (such as the above mentioned annular space).

The vacuum creation from above allows the container to be better cleaned, since it cleans the entire volume of the container.

Systems for hermetically closing a container, especially a bottle, systems for pumping a liquid or gas into a container, and systems for creating a vacuum are widely known in the art and should not be described in more detail.

According to a highly preferred embodiment of the invention, the device used for filling containers with a liquid according to the invention further comprises control means to keep the pipe and/or at least one of the tubes at a definite distance from the liquid level contained in said container, this is especially true even during the upward movement of the pipe or of at least one tube during the pouring of the liquid and the rise of its level. Such a distance ensures that the pipe or tube does not come into contact with the liquid, thus avoiding that the wet pipe or tube come into contact with air when moved from one container to the other, thereby inserting oxygen into the container in which the pipe or tube is inserted afterwards. In such a way the introduction of bacterial sources in the drops of liquid that can be found on the wet pipe/tube is also avoided, and consequently bacterial sources are not introduced in the next container.

The state of the art does not explicitly exclude the immersion of the liquid injector into the liquid; however, upon stopping the filling process, liquid flows back into the tube, and the same goes with gas, if the simultaneous suction of gas is not envisaged, as in one preferred embodiment of the invention. Such flowing back of the liquid or gas towards the corresponding tank may lead to pollution of the sources. In this invention, especially as for those embodiments wherein the injector tubes do not come into contact with the liquid and/or wherein gas is sucked by means of a suction device, preferably from the upper part of the container to be filled, the flowing back of liquid and/or gas to the liquid tank (or even to the gas tank) is excluded.

Such control means may be, for instance, photocells or cameras determining the liquid level and directing the elevating means according to the level of the determined liquid in order to ensure a definite distance between the pipe/tube and the liquid.

Such control means allow to keep the tubes at a definite distance from the liquid level, irrespective of the filling speed, the quantity of liquid poured into the container and the size of the container. The traditional injecting systems that rise upon filling of the container keep the distance between the injector and the liquid level by setting a steady speed for the injector that is calculated according to the filling speed and the volume of the container to be filled. By changing the speed or the type of container, the rising speed of the injector must be re-calculated and adjusted. If control means are present, the system is able to self-adjust according to the detection of the current position of the liquid level.

Another aspect of the invention relates to a method for filling containers with a liquid, in particular for bottling comprising the following step:

(i) simultaneously filling the container with the liquid and an inert gas through a pipe comprising a first tube and a second tube, wherein the first tube is arranged as central tube essentially coaxially inside the second tube creating, between said first tube and said second tube, a corresponding interstice, wherein the liquid flows through the central tube and the inert gas moves along the second external tube (i.e. through the interstice) or vice versa; or wherein said first and said second tubes extend one apart from the other, for instance in a parallel way, and wherein the inert gas moves along one of the two tubes and the liquid flows along the other. Alternatively, vacuum can be created on one of the tubes. The method according to the invention simultaneously at least uses two of the following components: liquid, inert gas and vacuum, thereby optimizing the outflow of air (oxygen) and inert atmosphere from within the container.

In a preferred variant of the method according to the invention, step (i) comes after the following step: (g) creation of vacuum inside the container. This step ensures that most of the air is extracted before introducing the liquid.

Advantageously, before step (i), preferably between step (g), if any, and step (i), the following step occurs: (h) inert gas is introduced in the container. Inert gas substitutes any air that might be present and creates an inert atmosphere. In particular, when gas is heavier than air—but not only in this case—what might be enough is creating a cushion made of inert gas above the liquid without filling the entire container with inert gas. Liquid is protected against air, since it is inserted into the container from the bottom and upon being inserted into the container it is below the inert gas cushion all the time.

In a highly preferred embodiment of the invention, during step (i) and, if any, optionally during step (h), a vacuum is simultaneously applied so as to create an inert gas cushion above the bottom of the container or above the liquid level, if it has already been poured into the container. The simultaneous presence of vacuum and inert gas injection allows to limit the inert atmosphere to an inert gas cushion, i.e. to a certain volume of inert gas, which is enough to protect the liquid during filling without needing to completely fill and empty with inert gas (more than once). In such a way, large quantities of inert gas and energy are saved when total vacuum is created. The person skilled in the art will easily find the right balance between the inserted gas and the (light) vacuum in order to create a protective cushion above the liquid. Vacuum is advantageously created from the upper part of the container, for instance from the neck of the bottle. Advantageously, the vacuum can be created in the upper part of the container.

A pressure difference between the tank containing the liquid and the container, which may be useful to fill it up, is advantageously created by means of vacuum created inside the container and a pressure corresponding to about the atmospheric pressure inside the tank where the liquid is contained; however, a pressure difference can, for example, also be created by having an elevated pressure in the tank (for instance, if carbonated liquids are used) and a slightly lower pressure with respect to the tank inside the container to be filled.

Preferably, the device and the method according to the invention can be managed by both the vacuum creation inside the container and a traditional isobaric process. In the latter case, the device has a tank containing liquid that can be pressurized.

Very advantageously, the filling of the container with inert gas and liquid starts from the bottom of the container. Preferably, during filling with inert gas and liquid, the pipe is raised so that there is no contact between the pipe and the liquid level. Advantageously, the distance between the pipe and the liquid level remains essentially the same during filling. The person skilled in the art will easily find the right distance to avoid turbulence inside the liquid due to the "falling" of the liquid coming out of the pipe from too high up on to the liquid that is already inside the bottle. By raising the pipe or at least the tube used to pour liquid and/or by lowering the container during filling, the pipe or at least one tube, through which the liquid is poured during the filling of the container with the liquid, does not come into contact with the level of the liquid poured in the container. The keeping of such a distance between the pipe/tube and the liquid has the above mentioned advantages and can be achieved by using control means, which have been specified above. Such control means control the level of the liquid and also permit to determine when the container achieves the desired filling level.

To this end, what must be pointed out is that the features described for one aspect of the invention may be transferred mutatis mutandis to the other aspect of the invention.

Vacuum is understood as various vacuum levels, not just a nearly complete vacuum, but also simple negative pressures if compared to ambient pressure surrounding the container.

The inert gas cushion is an inert gas layer with a specified thickness that does not correspond, at least at the initial filling stage, to the height of the space that inside the bottle is not occupied by the liquid. Suitable thickness means a few centimetres.

Preferably, the method according to the invention is achieved by using the device for filling containers with a liquid, particularly for bottling according to the invention.

Another aspect of the invention relates, more generally, to a method for filling containers with a liquid, in particular for bottling, wherein the liquid is poured through a pipe that does not come into contact with the level of the liquid poured in the container.

A last aspect of the invention relates, more generally, to a method for filling containers with a liquid, in particular for bottling, wherein upon pouring the liquid, inert gas is also injected and vacuum or negative pressure are created.

The technical details described above for the first variant of the method can be combined, individually or together (for instance, introduction of the liquid and inert gas starting from the bottom of the container, no contact between the pipe/tube and the liquid that has been already poured, vacuum creation from above, introduction of the liquid and gas at about the liquid level), with the other described variants of the method.

The reduction of oxygen and bacterial loads during filling, according to the invention, extends the shelf-life of the liquid and allows, as for wine, to reduce the amount of sulphur dioxide or, more generally, as for also other types of liquids, including medicines, to reduce the amount of other disinfectant or preservative additives.

Said objects and advantages will be better highlighted during the description of preferred embodiment examples of the invention given, by way of example and not of limitation. Variants of the invention are the object of the dependent claims. The description of preferred embodiment examples of the device and method for filling containers with a liquid, especially for bottling, according to the invention, is given by way of example and not of limitation, with reference to the attached drawings.

DESCRIPTION OF PREFERRED EMBODIMENT EXAMPLES

Referring to FIGS. 1 to 7, U generally refers to a filling unit of bottles B with wine V, which is part of a generally known bottling facility 1M, which substantially comprises a filling station S, in correspondence of which the filling unit U is positioned, conveyor means C capable of supporting and advancing in succession the bottles B below the filling unit U itself, and retaining means T of the neck N of each bottle B.

The filling unit U comprises a filling assembly 1 defined by a dispenser tap/dispenser 5, by a guide unit 2, of which an attachment portion 3 is adapted to be arranged, when in use, in correspondence of the inlet mouth I of each bottle B, and then brought into contact and in closed position therewith, at the upper outer end of the neck N of the bottle B itself (FIGS. 2 to 5).

Figure 8:
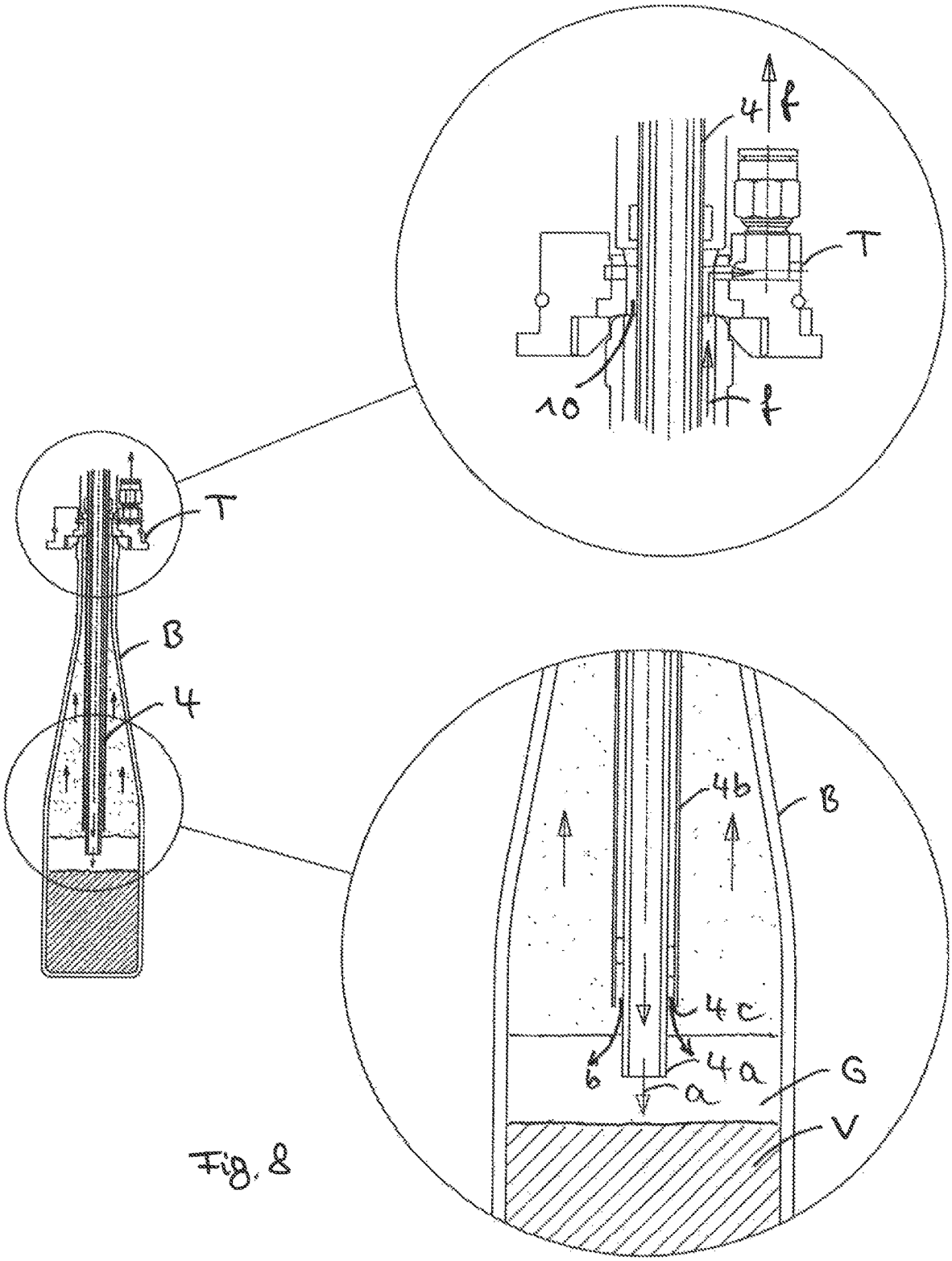
FIG. 8 shows in two details the retaining means with elements for the application of a vacuum and the pipe of the filler unit of FIG. 1, respectively from FIG. 9.5.

Coaxially within the guide unit 2, an injecting pipe 4 is slidingly arranged in an axially vertical direction to and from the inside and the bottom F of each bottle B through controlled electromechanical axis (not shown), said pipe consisting of a central tube 4*a* coaxially internal to a second tube 4*b* which holds it with a suitable interstice 4*c* between the two tubes 4*a* and 4*b* (FIG. 8).

The tubes 4*b* and 4*a*, i.e. the interstice 4*c* and the tube 4*a*, are connected alternatively and selectively by means of suitable ducts and known valve means (not shown) to a supply tank (not shown) of wine V and a source of inert gas G. In addition to the retaining means T, it is provided a suction group (not shown) to create a vacuum inside the bottle B.

Figure 1:
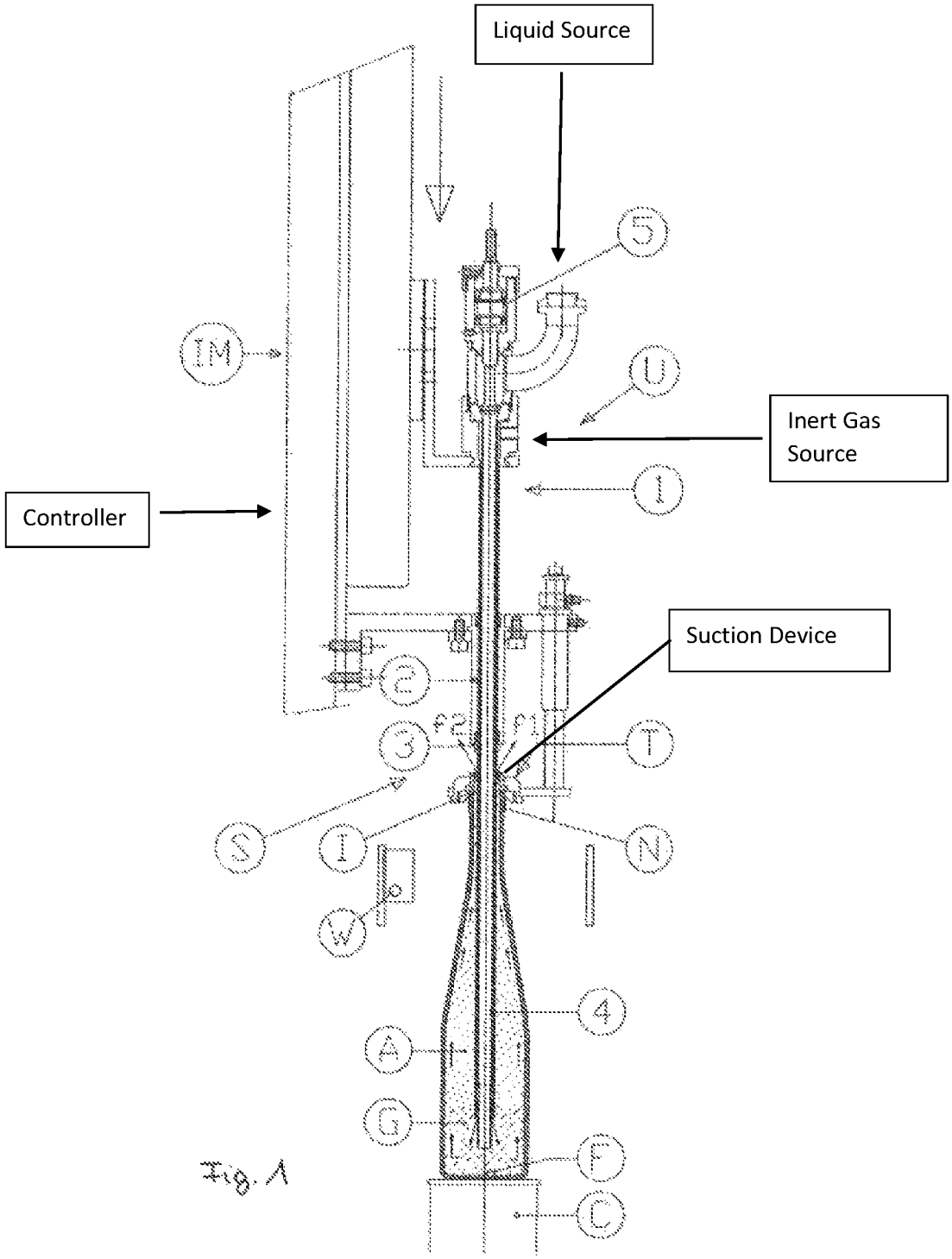
FIG. 1 shows a schematic side view, partially in vertical section and with removed parts for clarity, of an exemplary embodiment of a filling unit in a first operating position.

In use, the filling unit U is suitable for the bottling procedure of bottles B with wine V. An exemplary bottling sequence is shown in FIGS. 1 to 7:

In FIG. 1, in correspondence of the station S, each empty bottle B, held by the neck N by the retaining means T, is intercepted by the filling unit U, whose pipe 4 is slid onto the guide unit 2 to be inserted inside the bottle B until arriving with the opening close to the bottom F of the bottle B itself. The injecting of inert gas G is activated through the pipe 4 inside the bottle B so that the inert gas, flowing at appropriate pressure from the bottom F of the bottle B, is able to fully fill the bottle B (point-dash area inside the bottle) progressively ejecting completely the air A (dotted area inside the bottle) initially present inside the bottle B with a continuous and constant push from bottom to top allowing the total outflow of air A through spaces or gaps left free from the pipe 4 or the retaining means T and/or the attachment portion on the mouth I of the bottle (arrows f1 and f2 in FIG. 1) or, alternatively, by means of a suction group located in the retaining means T. In this way, the oxygen inside the bottle is eliminated and replaced with inert gas G.

Figure 2:
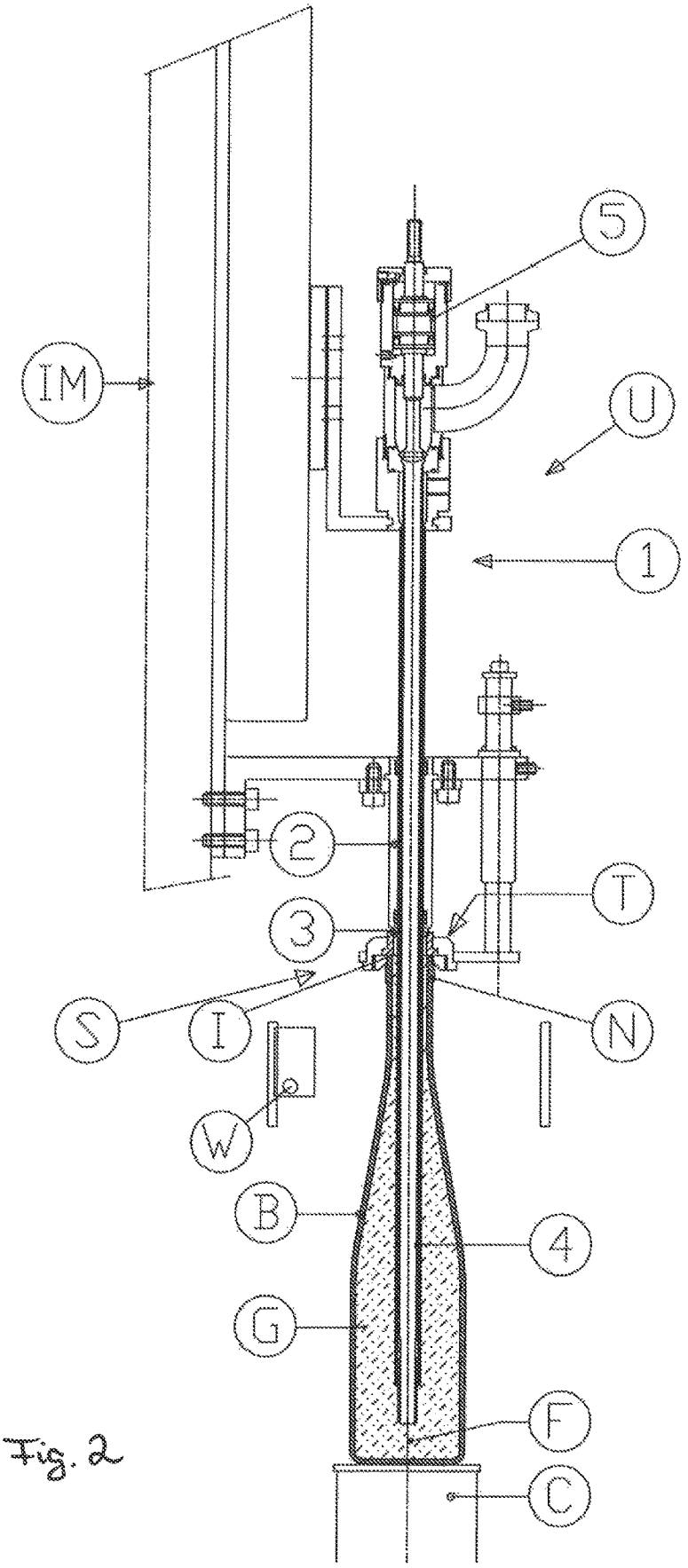
FIG. 2 shows the filling unit of FIG. 1 in a second operating position.

In FIG. 2, the attachment portion 3 of the guiding unit is in contact and sealed to the mouth I of the bottle B which is filled with inert gas G (point-dash area within the bottle).

Figure 3:
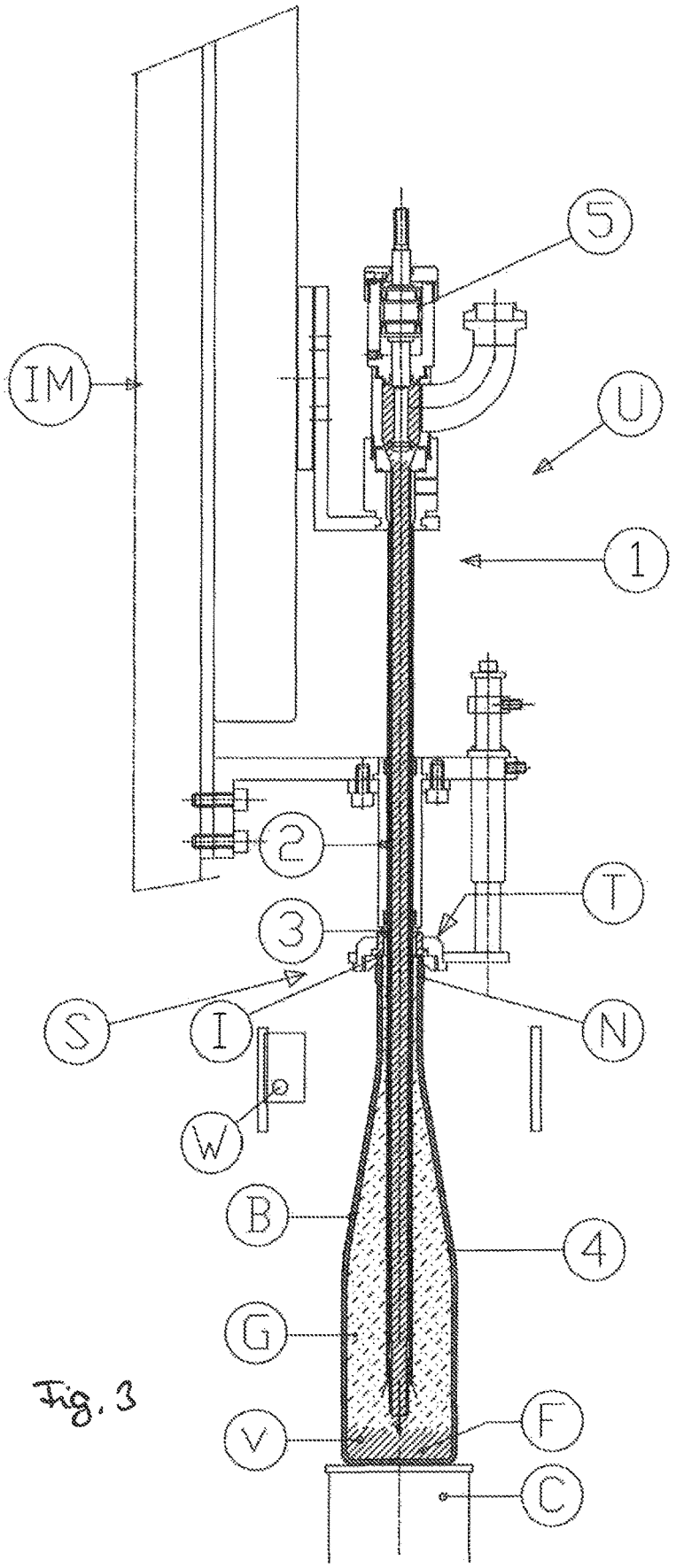
FIG. 3 shows the filling unit of FIG. 1 in a third operating position.

In FIG. 3, the step of injection of wine V in the bottle B is activated. The pipe 4, positioned with the opening next to the bottom F of the bottle B, is connected with one of its tubes 4*a* and 4*b* to the wine V supply tank, simultaneously creating a slight vacuum with the suction group. The vacuum has the dual function of assisting the wine V flow and aspirating the gas G that the wine should gradually replace in the bottle B. At the same time, through the tube not used by wine, an inert gas may optionally be introduced.

Figure 4:
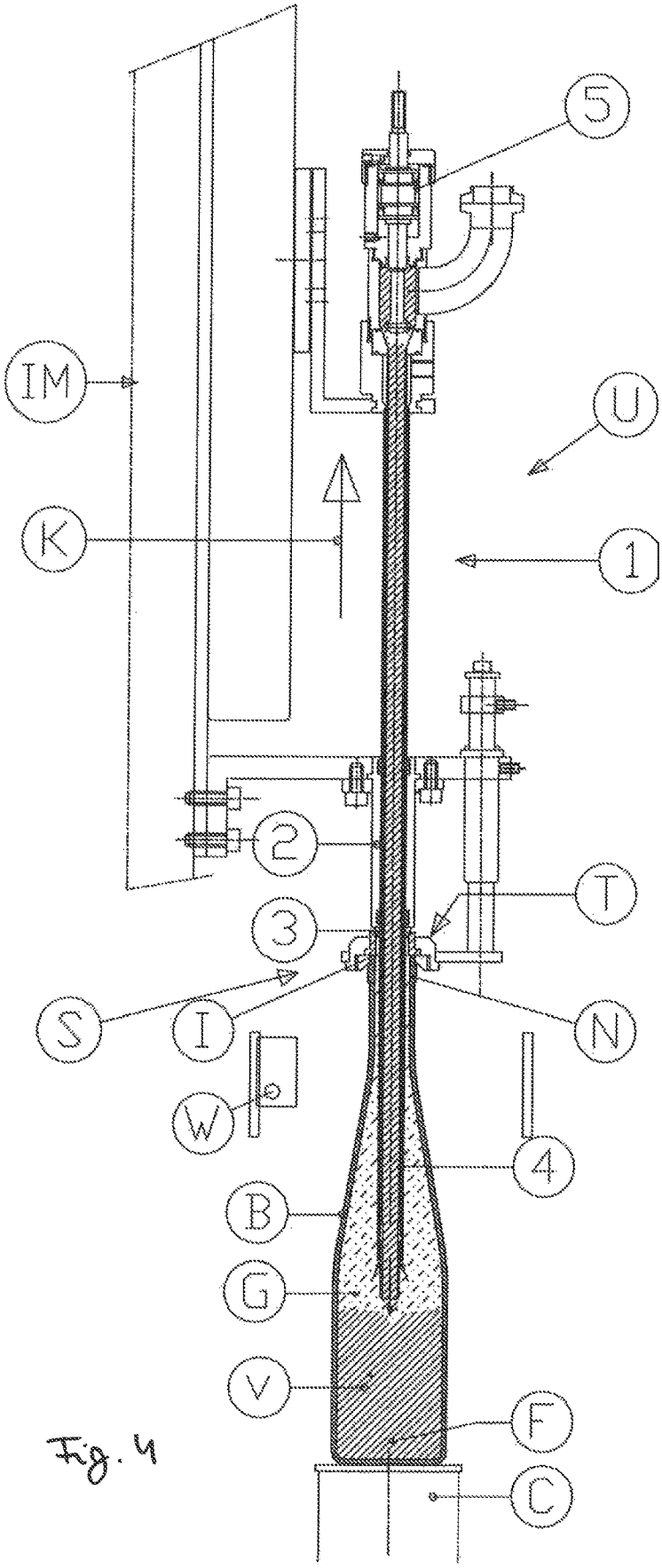
FIG. 4 shows the filling unit of FIG. 1 in a fourth operating position.
Figure 5:
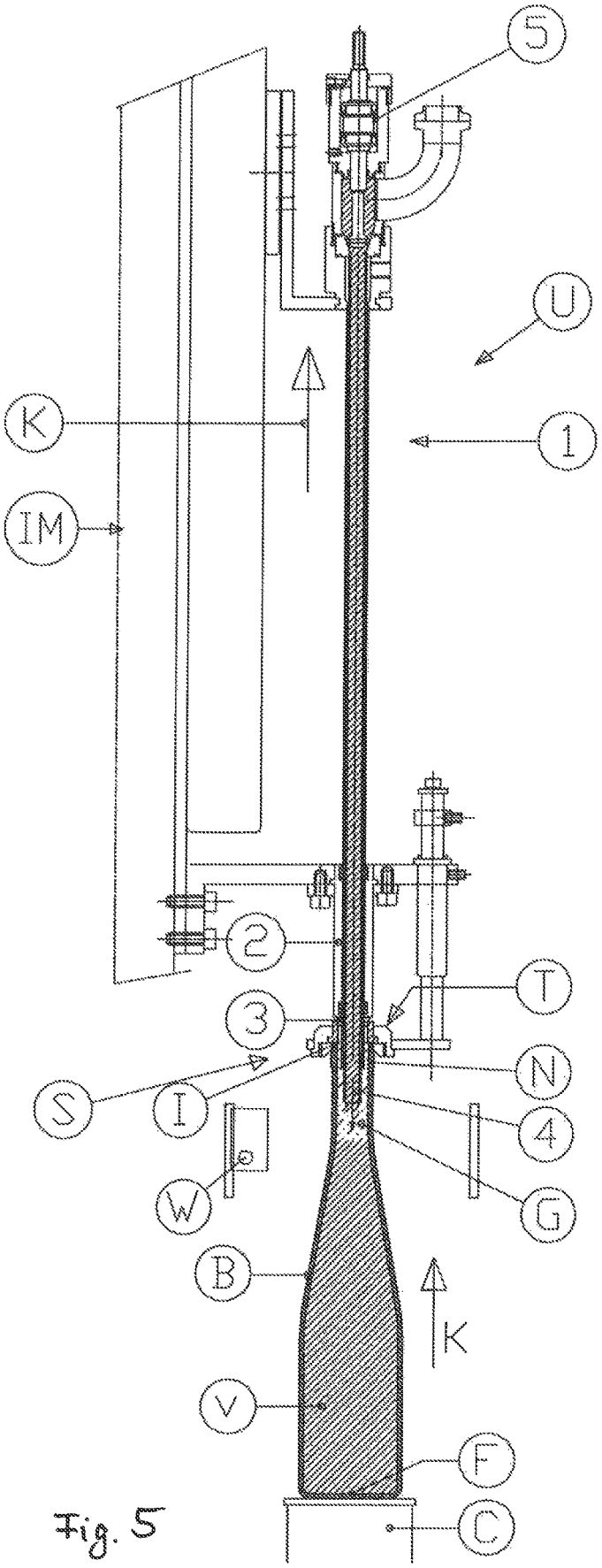
FIG. 5 shows the filling unit of FIG. 1 in a fifth operating position.

In FIGS. 4 and 5 it is seen that, as the wine V flows into the bottle B, the pipe 4 rises simultaneously and accordingly to the progressive rise of wine V, thereby maintaining a constant distance and no contact with the liquid. The rise from the bottom F arrives next to the neck N (arrow K) so as to completely fill the bottle B until reaching the desired final/predefined level, precisely determined by an electronic photocell or camera electronic system W. Advantageously, the wine V comes out of the central tube 4*a*, while the inert gas and, in variants of the device, the vacuum are applied to the interstice 4*c*. The filling from the bottom and not from above along the walls (umbrella filling) of the bottle causes wine V to be poured into the bottle without stress and without foam, thus greatly limiting the absorption of oxygen which is instead maximized by turbulence, resulting in foam, which is created in the traditional "umbrella" filling along the bottle walls. In addition, at this stage and in any other part of the filling process, the pipe 4 never comes into contact with the poured wine, which is important to avoid possible bacterial contaminations or re-introduction of oxygen between the wine and the pipe head, which during the production process comes into contact with air and is exposed to pollution when passing from a bottle to another. Very likely pollution, being the pipe 4 always wet with wine if in contact with the level of the liquid. The control of the final level of bottle B next to the neck N by means of a photocell or camera system W coupled to electronic volumetric filling, ensures the constant level in the production process without allowing the pipe 4 to come into contact with the wine as is usually the case of the filling heads of the traditional systems, wherein the pouring of wine is always carried out with the contact of the wine in the bottle.

Figure 6:
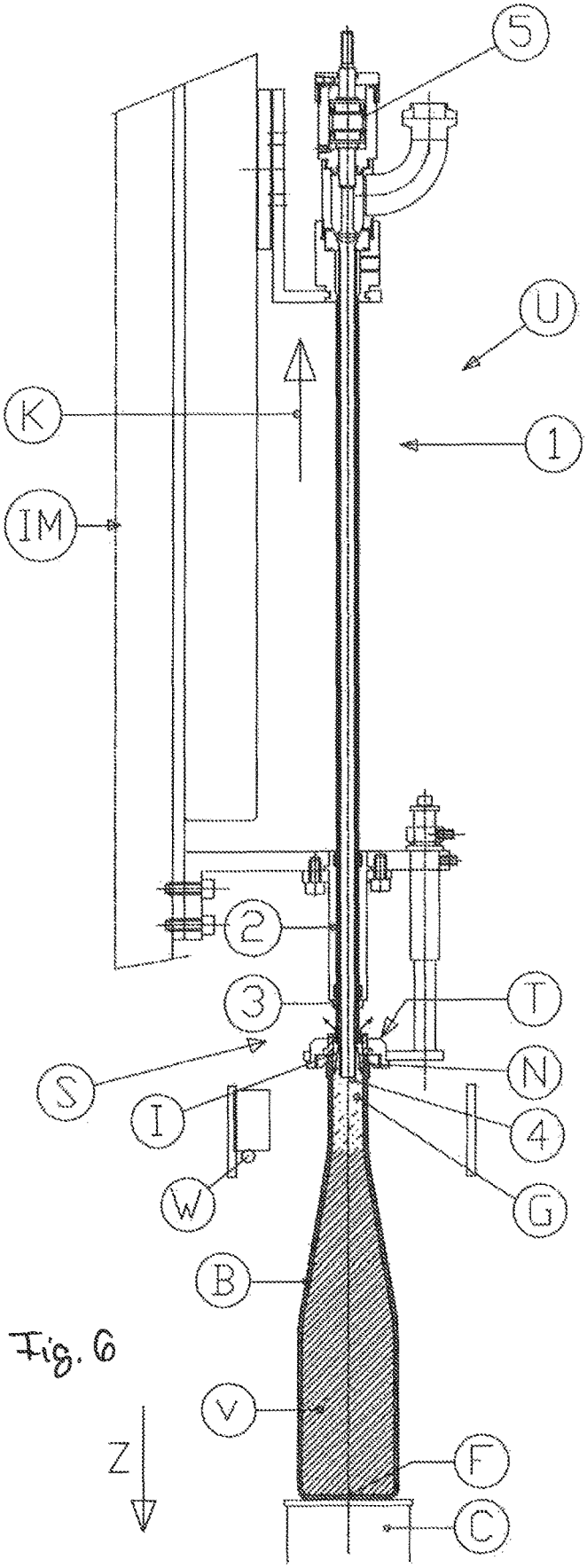
FIG. 6 shows the filling unit of FIG. 1 in a sixth operating position.

In FIG. 6, the attachment portion 3 of the guide unit 2 is removed from the mouth I of the bottle, also by a relative and progressive downward movement of the conveyor means C supporting the bottle B itself, and preferably with simultaneous injection of inert gas G through the pipe 4 in the neck N of the bottle B.

Figure 7:
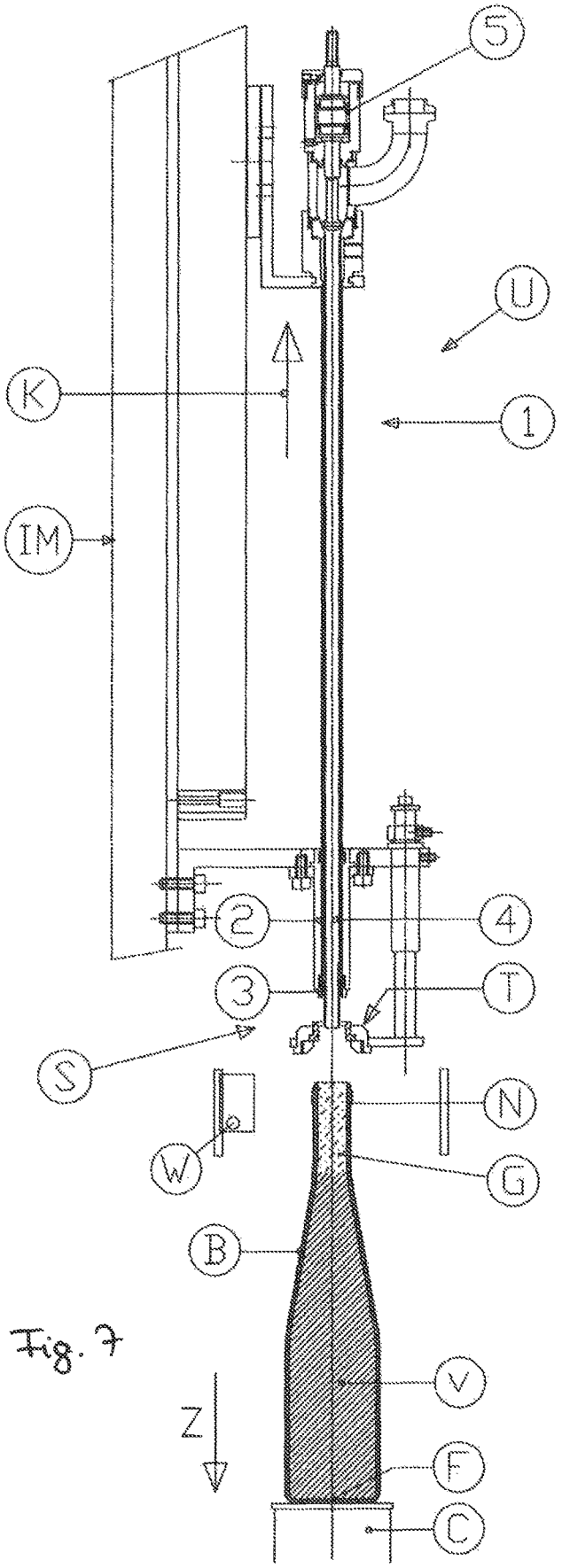
FIG. 7 shows the filling unit of FIG. 1 in a seventh operating position.

In FIG. 7, the bottle B filled in this way with wine V, is further moved down (arrow Z) so as to release it from the retaining means T. The bottle is then ready to be fed to a subsequent capping step, while the filling unit U is ready to receive a new empty bottle and to start a new filling cycle with wine.

FIG. 8 shows a detail of the filling unit U of FIG. 1 (referring to FIG. 9.5), and specifically of the retaining means T and of the pipe 4. The retaining means T comprise spaces 10 for the release of the gas G (arrow f) surrounding the pipe 4 in a coaxial form, thus creating a triple tube at the top of the pipe 4. The pipe 4 is clearly a double tube in which a central tube 4*a* is coaxially housed within an outer tube 4*b* with a greater diameter creating an interstice 4*c* between the tubes. Wine and gas are simultaneously and separately injected through the two tubes 4*a* and 4*b* (advantageously, the wine through the central tube 4*a* in order to reduce turbulences). The wine descends from the central tube 4*a* (arrow a) and the inert gas from the tube 4*b* (arrow b), i.e. from the interstice 4*c*.

Figure 9:
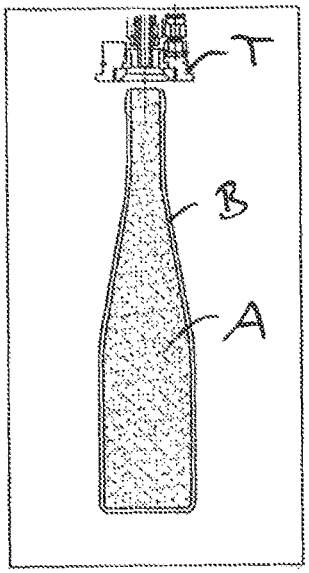
FIG. 9 shows a schematic form of an alternative succession of filling phases with respect to that shown in FIGS. 1 to 7.
Figure 9:
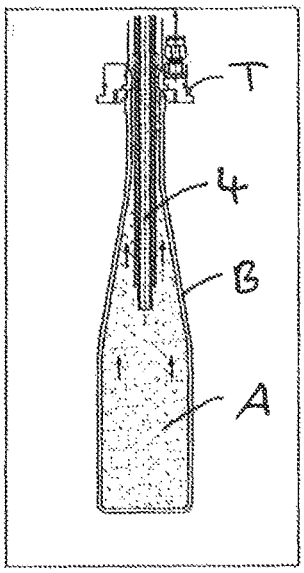
Figure 9:
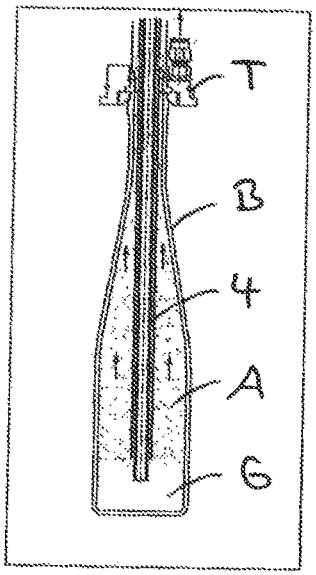
Figure 9:
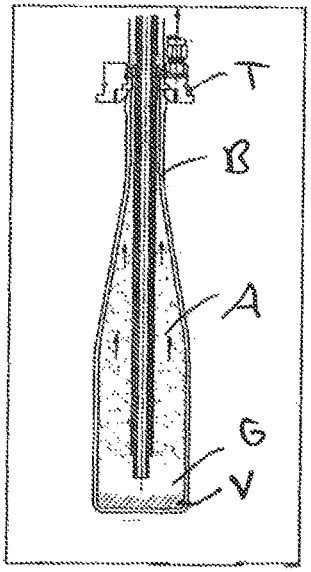
Figure 9:
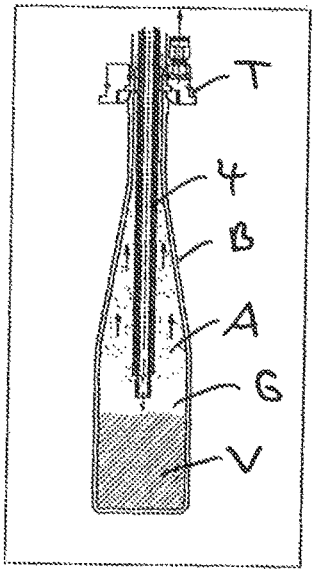
Figure 9:
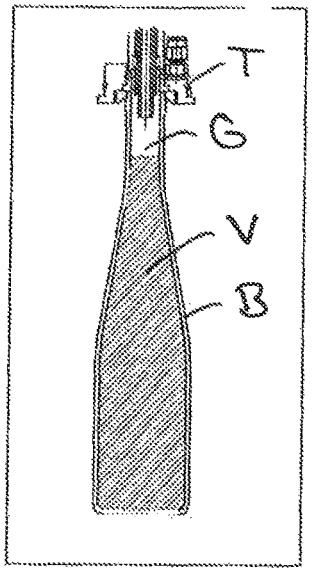

Finally, FIG. 9 shows an additional variant for a container filling procedure. In FIG. 9.1 it is possible to see the bottle B filled with air A, thereby containing oxygen. The retaining means T are not yet fixed on the neck N of the bottle. In the following step (FIG. 9.2), the neck N of the bottle is hermetically sealed. A vacuum is applied at neck N height, while at the same time the double-tube pipe 4 drops. The air is extracted through the retaining means T. The symbol A now means a less dense air, since a vacuum has been applied. In FIG. 9.3, the pipe 4 is next to the bottom F of the bottle B and the step of injecting inert gas through the interstice 4*c* or the tube 4*b* of the pipe 4 is initiated, simultaneously a vacuum is being applied, the balance between gas and vacuum injection causes a gas G cushion inside the bottle B to be created. The symbol A now means a mixture of air and inert gas, wherein the air constantly decreases. In FIG. 9.4, the simultaneous injection of inert gas (through the interstice 4*c*) and wine (through the central tube 4*a*) begins. The simultaneous application of a vacuum keeps the gas cushion constant, always covering and protecting the wine V. The cushion system allows great gas savings. Although the space called A still needs to contain air (mixed with inert gas and liquid vapour), the liquid V is however protected by the inert gas cushion. In FIG. 9.5 it is still shown the filling of the bottle B with wine and gas with vacuum application, wherein the pipe 4 rises as the wine level rises to avoid a contact between wine and pipe. At the end of the filling, clear from FIG. 9.6, the volume above the wine is filled with inert gas resulting from the above cushion.

Figure 10A:
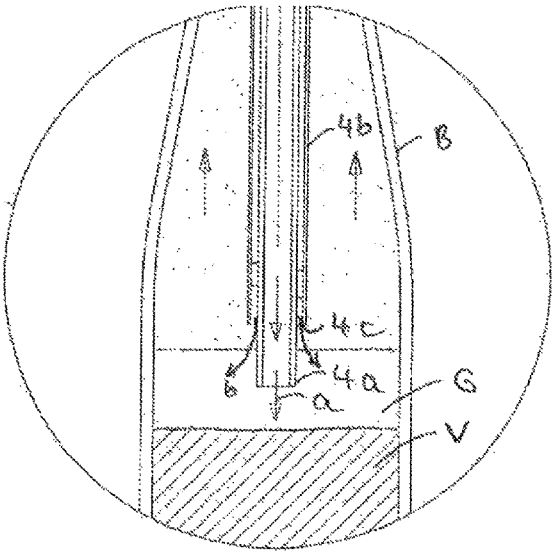
FIGS. 10A and 10B depict the tubes movable relative to one another.
Figure 10B:
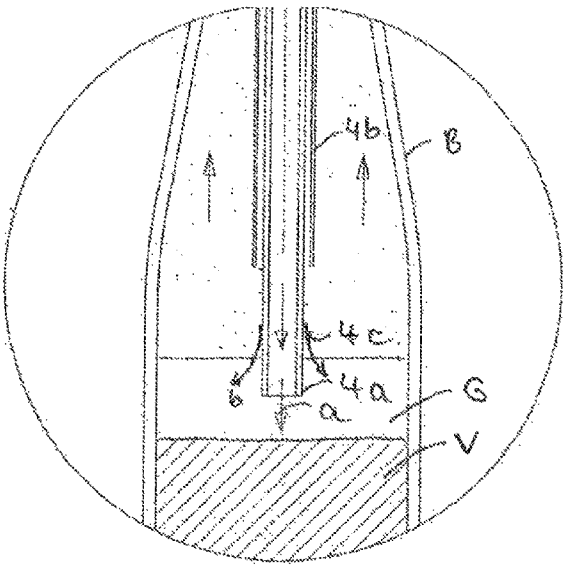

In another embodiment of the invention, the first and second tubes can be raised or lowered independently of each other, as seen in FIGS. 10A and 10B, thus allowing, for instance, a bottom up filling of the container with liquid or inert gas and the creation of vacuum from above, if vacuum is created by means of one of the tubes. The resulting different height of the two tubes allows liquid and gas to be injected, or vacuum to be created from different heights.

During operation, further embodiment modifications or variants of the device and method for filling containers with a liquid, in particular for bottling, subject-matter of the invention and not described herein, may be implemented. If such modifications or such variants should fall within the scope of the following claims, they should all be considered protected by the present patent.

The invention claimed is:

1. A device for filling a container with a liquid, comprising:

a filling unit, comprising:

connections connected to a source of the liquid, a source of an inert gas and a suction device;

a pipe comprising a first tube and a second tube;

a third tube, a bottom end of the third tube being above a bottom end of the first tube and a bottom end of the second tube;

a retainer to hold a container in the filling unit; and a controller configured to maintain said at least one of said tubes at a determined distance from a level of the liquid residing in said container, wherein said first and second tubes are each connected to one of said connections connected to the source of liquid and to the source of an inert gas, respectively and the third tube is connected to the suction device, and wherein a bottom end of the third tube is above a bottom end of the first tube and a bottom end of the second tube and located radially outwardly from the first tube and the second tube.

2. The device for filling a container with a liquid according to claim 1, wherein said elevating mechanism is configured to move at least one of said tubes in an axial direction and/or said elevating mechanism is configured to raise and to lower a support onto which said container is positioned in said filling unit.

3. The device for filling a container with a liquid according to claim 2, wherein said filling unit is configured to close the container so as to create through said suction device a negative pressure or a vacuum.

4. The device for filling a container with a liquid according to claim 2, further comprising a controller configured to maintain said pipe and/or at least one of said tubes at a determined distance from the level of the liquid residing in said container.

5. The device for filling a container with a liquid according to claim 2, wherein the first tube is connected to the connection connected to said source of liquid and the second tube is connected to the connection connected to said source of inert gas.

6. The device for filling a container with a liquid according to claim 1, wherein said filling unit is configured to close the container so as to create through said suction device a negative pressure or a vacuum.

7. The device for filling a container with a liquid according to claim 6, further comprising a controller configured to maintain said pipe and/or at least one of said tubes at a determined distance from the level of the liquid residing in said container.

8. The device for filling a container with a liquid according to claim 1, wherein the first tube is connected to the connection connected to said source of liquid and the second tube is connected to the connection connected to said source of inert gas.

9. The device for filling a container with a liquid according to claim 1, wherein the first tube and second tube are separately movable.

10. A method for filling a container with a liquid, comprising the following step:

filling said container simultaneously with said liquid and an inert gas through a pipe which comprises a first tube and a second tube;

applying a vacuum through a third tube, a bottom end of the third tube being above a bottom end of the first tube and a bottom end of the second tube, wherein said inert gas runs down through the first tube and said liquid through the second tube, and wherein the method further comprises the steps of:

raising the first tube and the second tube during the filling, wherein the first tube and the second tube during the filling of said container with said liquid are not in contact with the level of the liquid poured into the container.

11. The method for filling a container with a liquid according to claim 10, wherein said step of filling said container simultaneously with said liquid and an inert gas is preceded by the following step:

creating a vacuum in said container.

12. The method for filling a container with a liquid according to claim 11, wherein prior to said step of filling said container is inserted the following step:

introducing said inert gas into said container.

13. The method for filling a container with a liquid according to claim 10, wherein prior to said step of filling said container simultaneously with said liquid and an inert gas:

said inert gas is injected into said container.

14. The method for filling a container with a liquid according to claim 13, further comprising the step of:

raising the tube through which said liquid is injected; and/or lowering said container during the filling, wherein the tube through which said liquid is injected during the filling of said container with said liquid is not in contact with the level of the liquid poured into the container.

15. The method for filling a container with a liquid according to claim 10, wherein in said step of filling said container is simultaneously applied a vacuum so to create an inert gas cushion on the bottom of the container or on a level of the liquid if already residing in the container.

16. The method for filling a container with a liquid according to claim 10, wherein in said step of filling said container, the filling of the container with the inert gas and application of a vacuum are carried out in an alternating manner.

17. The method for filling a container with a liquid according to claim 10, wherein said method is implemented using a device for filling a container with a liquid, comprising:

a filling unit, comprising:

connections connected to a source of the liquid, a source of an inert gas and a suction device;

a pipe comprising the first tube and the second tube, a retainer to hold said container in the filling unit;

an elevating mechanism configured to vary the depth with which said pipe and/or at least one of said tubes is inserted in said container; and a conveyor configured to support and have said container advance in succession to said filling unit, wherein said tubes are each connected to one of said connections connected to the source of liquid, the source of an inert gas and suction device.

18. The method for filling a container with a liquid according to claim 10, further comprising separately moving the first tube and second tube.

* * * * *